US005827566A

United States Patent [19]

Epple et al.

[11] Patent Number: 5,827,566

[45] Date of Patent: Oct. 27, 1998

[54] PROCESS AND DEVICE FOR WETTING PARTICLES WITH A FLUID

[75] Inventors: Albrecht Epple, Hamm; Herbert Nopper, Kuppenheim; Wolfgang Haag, Stadecken-Elsheim, all of Germany

[73] Assignee: Carl Schenck, Darmstadt, Germany

[21] Appl. No.: 604,754

[22] Filed: Feb. 23, 1996

[30] Foreign Application Priority Data

Feb. 23, 1995 [DE] Germany ..... 195 06 353.8

[51] Int. Cl.[6] ..... B05D 1/02

[52] U.S. Cl. ..... 427/8; 427/212

[58] Field of Search ..... 427/212, 8

[56] References Cited

U.S. PATENT DOCUMENTS 4,141,316 2/1979 Grun ..... 427/212
4,510,184 4/1985 Winkler et al. ..... 427/212
5,188,868 2/1993 Horii et al. ..... 427/212

FOREIGN PATENT DOCUMENTS

21943/92 2/1993 Australia ..... 427/212
1632450 12/1970 Germany .

OTHER PUBLICATIONS

Webster's Ninth New Collegiate Dictionary, Merriam–Webster, Inc., pp. 387 and 1214, (no month date 1990).

*Primary Examiner*—Katherine A. Bareford
*Attorney, Agent, or Firm*—Felfe & Lynch

[57] ABSTRACT

Disclosed are a process and a device for wetting pneumatically transported particles with a fluid where the fluid is sprayed by means of nozzles into a transport line through which the particles are flowing. The nozzles are installed in an area of the transport line which has a diffusor-like expansion in its cross section to insure that the particles are wetted uniformly and in a finely divided manner.

9 Claims, 2 Drawing Sheets

PROCESS AND DEVICE FOR WETTING PARTICLES WITH A FLUID

BACKGROUND OF THE INVENTION

The present invention is in a process for wetting particles with a fluid and to a device for wetting particles with a fluid. Processes and devices of this type are used to apply glue to fibers, for example, as part of the production of board-like materials from chips and fibers, especially fiberboard (boards of wood material and construction panels of mineral and/or textile and/or synthetic fibers). A process and a device of this type are known from DE-OS No. 3,143,895 which describes a gluing zone in which chips are glued. The zone has a constant cross section, and a gluing nozzle is provided inside the cross section through which the particles flow. It has been found that it is impossible in such an arrangement to prevent the occurrence of glue spots, which form when the chip-like and fiber-like particles are glued. This is because the particles tend to form tangled clumps, which the known device is unable to loosen or separate sufficiently before gluing.

An object of the present invention is therefore to provide a process and a device of the general type described above which make it possible, with simple mechanic equipment to wet materials with a fluid at low cost, the wetting itself being characterized by an especially uniform and fine distribution.

SUMMARY OF THE INVENTION

The above stated object is obtained in the process according to the invention in that the particles are fed from a hopper into a transport line and pneumatically conveyed to a station for further processing and are sprayed into a wetting zone wherein within the wetting zone, the particle stream, i.e., clumps, tangles, is loosened by a reduction in its flow velocity. The object is also accomplished by a device for wetting pneumatically transported particles with a fluid which is sprayed by at least one nozzle into the transport line through which the particles are flowing wherein at least one of the nozzles is installed in an area of the transport line which has a diffusor-like expansion of its cross section.

As a result of the solution according to the invention, a turbulent flow is produced during the wetting phase. The turbulence breaks up the particle stream to such an extent that the individual particles can be wetted. The formation of clumps is effectively prevented. Because of the abrupt reduction in the flow velocity, extreme turbulence is created in the wetting zone breaking up any particle aggregations which may be present.

The separation of the particles can be improved even more by providing in the transport line an acceleration section of reduced diameter proceeding the wetting zone because this intensifies the effect of the shock-like transformation from a rapid laminar flow to a slow turbulent flow.

The various features of novelty which characterize the invention are pointed out with particularity in the claims annexed to and forming a part of this specification. For a better understanding of the invention, its operating advantages and specific objects obtained by its use, reference should be made to the accompanying drawings and descriptive matter in which there is illustrated and described a preferred embodiment of the invention.

DESCRIPTION OF THE PREFERRED EMBODIMENT

Figure 1:
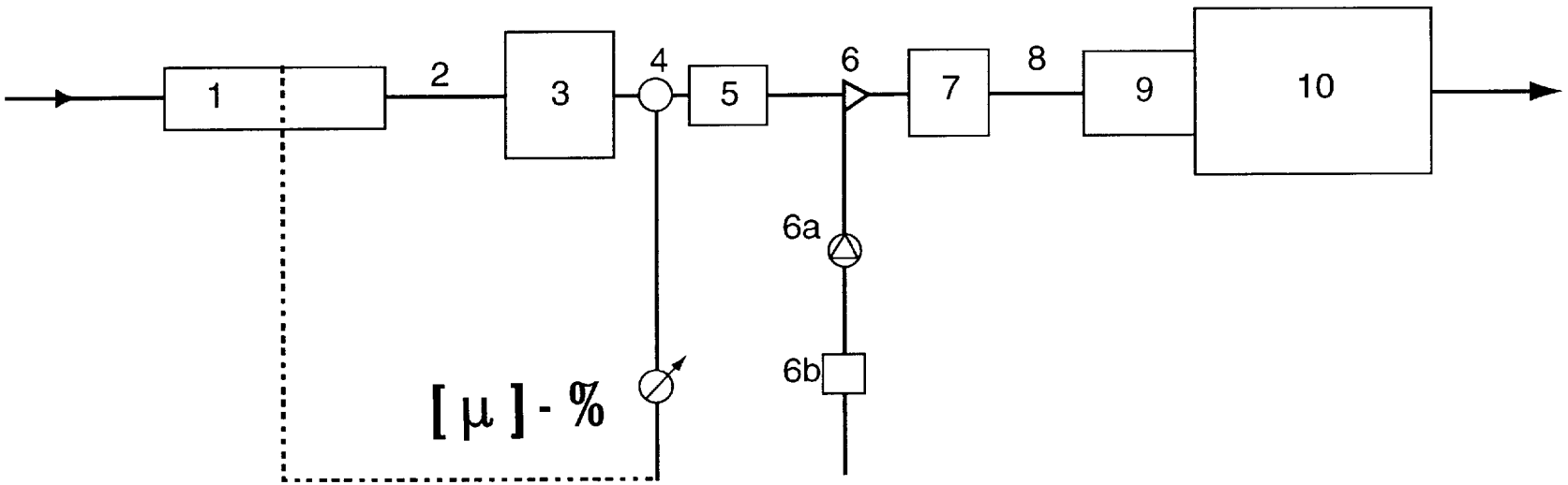
FIG. 1 shows an overall schematic diagram of the process of the invention in the production of fiberboard.

The process and device of the invention are suitable for the gluing of fibers, especially wood fibers. Fibers, especially when dry, have a very pronounced tendency to form clumps or tangles, but because of the extremely effective way in which the particle stream, in this case the stream of fibers, is broken up in the invention, it is possible to glue economically and uniformly even these dry fibers in the air stream. Previously, gluing has been carried out with wet fibers because of the problem of clump formation. These glued fibers were then dried. The drying of the fibers after gluing suffers from the significant disadvantage that 5–15% of the amount of glue used is lost as a result of premature hardening and volatilization; and it must also be remembered that the amount of formaldehyde, which is proportional to the amount of glue, pollutes the exhaust air leaving the dryer and necessitates expensive environmental protection measures. The gluing of already dry fibers also offers the advantage that, because of the lower moisture content (5–12%), the effect of pH on the resin is sharply reduced.

In a preferred embodiment of the invention, steam is injected into the particle stream so that the moisture content of the material stream can be adjusted after gluing.

It is also advantageous to provide a weighing station to determine the actual throughput as part of the process and as part of the device. This value can then be used as an input value for the automatic control of the amount of fluid to be injected and/or of the composition of the fluid.

It is advantageous for the walls of the wetting zone to be tempered to prevent the wetting fluid from baking onto the transport line in the area of the wetting zone. For example, when the device according to the invention is used as a gluing station, the temperature of the inside lateral surface of the wetting zone can be lowered below the dew point by cooling. This measure reliably prevents the glue from becoming baked on.

By providing a station which exerts an effect on the charge state of the flowing particles, it is possible to improve significantly the fineness with which the particles are wetted. The effect of charging the particles in combination with an appropriate charge state of the wetting fluid improves the bond between the fluid and the particles and thus prevents the formation of spots.

To produce a uniformly fine spray at all times regardless of the load, that is, even in the presence of fluctuations in the throughput of fluid, it is advantageous to inject the fluid through return-flow nozzle lances, which are known in themselves.

If the transport line is supplied with a preheated stream of air, the air temperature being under 1000° C., preferably in the range of approximately 50 ° –700° C., the moisture content of the particles, especially wood fibers, can be made more uniform. It also becomes possible for gluing to be carried out in a second dryer stage, and the pressing times during the production of wood fiberboard can be reduced even without the addition of steam.

In an advantageous embodiment of the invention, the wetting is carried out with a preheated binder. The binder temperature should be below 80° C., preferably in the range of 40°–60° C. This measure makes it possible to decrease the amount of dilution water needed, and this makes it possible in turn to reduce the amount of energy consumed by the dryer. In addition, it is also possible to use a binder containing a larger percentage of solid resin. Because such a binder is absorbed less strongly by the particles, the problem of so-called "sagging away", or premature settling out, is avoided. Heating the binder also keeps its viscosity in a range in which the nozzles can produce an optimum mist even without dilution.

Referring to the drawing, FIG. 1 shows, in the form of a block diagram, a section of a system for the production of boards out of wood fibers or, for example, MDF boards. The previously prepared fibers are first sent to a dryer 1, from which they are conveyed by pneumatic transport 2 to a fiber hopper 3. The moisture content is measured at 4, and the output signal of the meter is used to control dryer 1. Before being transported pneumatically through the transport line and reaching a wetting zone 6, the fibers pass through a weighing station 5, which can be designed as a belt weigher or as a mass-flow rate measuring device.

In wetting zone 6, at least one gluing nozzle, described below, is provided, which can inject fluid into the transport line. For this purpose, the gluing nozzle is connected to a high-pressure pump 6*a*, which is fed from an upstream tank 6*b*. After the gluing operation, which is described further below on the basis of FIG. 2, the glued fibers pass through a separator 7 and are then sent pneumatically via pneumatic transport 8 to scattering hopper 9, which is part of forming station 10. There the glued fibers are scattered to form a mat and then pressed into boards.

Figure 2:
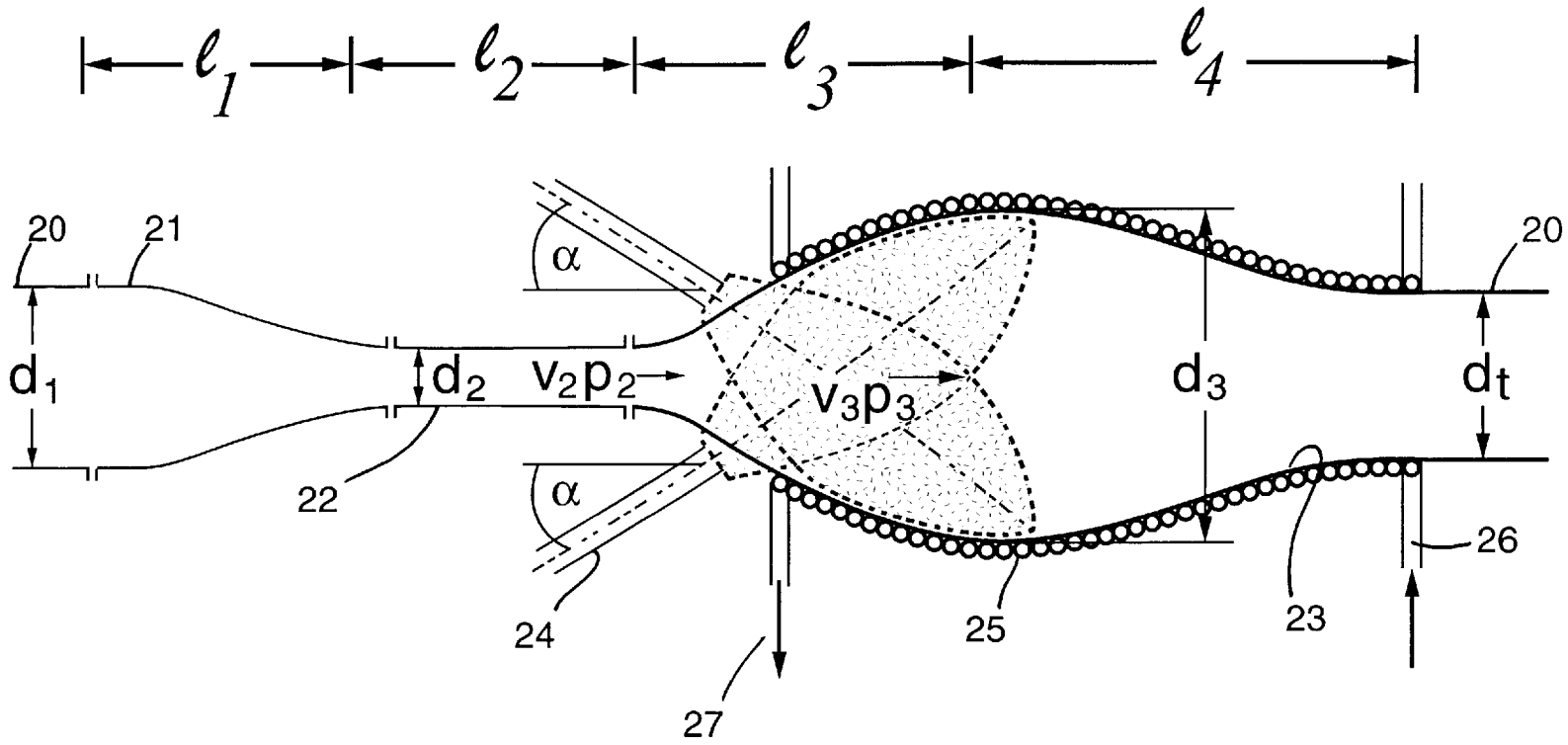
FIG. 2 shows a section of a transport line containing a device according to the invention.

FIG. 2 shows a section of the transport line between mass-flow rate measuring station 5 and separator 7, namely, the section which contains wetting zone 6. To accomplish the wetting process, a reducing piece 21, an intermediate pipe 22, and a diffusor section 23 are inserted into transport line 20, which has a diameter of $d_1$. Reducing piece 21 tapers down in the transport direction in the same way as a venturi nozzle to a diameter of $d_2$, which is the same as that of intermediate pipe 22. Diameter $d_2$ of reducing piece 21 is approximately 25–35% smaller than diameter $d_1$ of transport line 20. Diffusor section 23 expands initially in the flow direction into a bulge with a diameter of $d_3$, which is about 10–70% larger than diameter $d_1$ of transport line 20. This expansion occurs over a length $l_3$; following this expansion is a tapered section, extending over a length $l_4$, leading to a smaller diameter, which is again the same as diameter $d_1$ of transport line 20, to which diffusor section 23 is flanged.

In the area of diffusor section 23 where the cross section increases, several gluing nozzles 24 are spaced uniformly around the periphery in such a way that all of the fibers flowing by are uniformly wetted with equal probability by the injected mist of glue. To achieve this goal reliably, the spray cone of each gluing nozzle, and its orientation $\alpha$ with respect to the horizontal center axis of the transport line, are designed to be adjustable.

Gluing nozzles 24 are designed as return-flow nozzle lances known in themselves, which ensure that, regardless of fluctuations in the flow rate over time, the same fine uniform spray mist is always generated automatically.

The diffusor section consists of high-grade, nonporous, polished material to prevent glue deposits. So that the temperature on the inside lateral surface of the diffusor section can be brought down below the dew point, which also prevents the glue from baking on, the diffusor section is surrounded by multiple turns of a cooling coil 25, with a coolant inlet 26 and a coolant outlet 27. To prevent the glue from baking on, it is also advantageous for the wetting zone to be lined with a sheet of flexible separation material. The zone could also be lined with a double sheet of material, and a tempering fluid could be conducted through the space between the material layers.

The fibers, pneumatically conveyed through horizontal transport line 20, are accelerated on reaching reducing piece 21 and reach their maximum velocity $v_2$ in intermediate pipe 22. Thus a laminar flow develops. As this flow enters diffusor section 23, the fibers are decelerated abruptly to velocity $V_3$, with the result that the flow becomes turbulent. This turbulence is highly effective at breaking up the fiber stream, so that the conveyed material is now present in the form of individual fibers. Any fiber clumps which may have been present previously are broken up. This stream of finely divided fiber passes through the glue mist injected by gluing nozzles 24 in the wetting zone which corresponds approximately to section $l_3$ of length. There the individual fibers are uniformly wetted with the fine glue mist.

Since the fibers are supplied to the wetting zone after pre-drying, the gluing can be performed at room temperature, which means that the amount of glue which must be used per unit quantity of fiber can be adjusted to a low, economically favorable value. Gluing can also be carried out in a stream of preheated air at temperatures of less than 100° C., preferably of 50 ° 75° C., in order to introduce as much thermal energy as possible into the fiber mat to be formed by the scattering of the fibers. Furthermore, it is now possible to use isocyanate based binders. Isocyanate binders are unsuitable for conventional gluing because of their sensitivity to moisture and temperature.

Ionization rods (not shown) are installed to project into transport line 20 in an area of the line situated upstream of the gluing zone. These rods are used to bring about a change in the electrical charge state of the fibers. This measure, in conjunction with a glue carrying the opposite charge, increases the quality and the efficiency of the gluing operation. Steam injectors (not shown) are also installed at a suitable point in the transport line, so that it is possible to regulate the moisture content of the fibers with precision.

Transport line 20, reducing piece 21, intermediate pipe 22, and diffusor section 23 can also have a polygonal cross section instead of the above described rotationally symmetric cross sections. Diffusor section 23 and/or reducing piece 21 need not have the streamlined shape described; on the contrary, cross-sectional discontinuities or ramps can also be present.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

We claim:

1. A process for wetting particles with a fluid, the process comprising:

(a) feeding the particles into a transport line;

(b) pneumatically conveying the particles through the transport line; and (c) passing the particles flowing through the transport line into a wetting zone inside a duct, wherein the particle stream is broken up by a reduction in its flow velocity and the fluid is sprayed onto the particles; and wherein the flow velocity of the particles is increased after said particles enter the transport line and before said particles enter the wetting zone; and wherein the particles are dried prior to introduction thereof into the particle stream.

2. The process of claim 1, wherein subsequent to the wetting, the particles are pneumatically conveyed to a station for further in a duct.

3. The process of claim 1, further comprising injecting steam into the particle stream.

4. The process of claim 1, further comprising determining the throughput of the particles, and based on the determination controlling the amount of fluid to be sprayed in and/or the composition of the fluid.

5. The process of claim 1, wherein before the particles are wetted, the electrical charge state of the particles is controlled.

6. The process of claim 1, wherein the fluid is a binder.

7. The process of claim 1, wherein said pneumatically conveyed particles are in an atmosphere having a dew point and the wetting zone has a lateral surface which is maintained at a temperature below the dew point.

8. The process of claim 1, wherein the wetting is carried out at a temperature below 100° C.,.

9. The process of claim 8, wherein the temperature is 50° to 75° C.

* * * * *

UNITED STATES PATENT AND TRADEMARK OFFICE

CERTIFICATE OF CORRECTION

PATENT NO. : 5,827,566

DATED : October 27, 1999

INVENTOR(S) : Epple et al.

It is certified that error appears in the above-identified patent and that said Letters Patent is hereby corrected as shown below:

In column 2, line 56, change "700 °C" to read as - - 70 °C - -.

Signed and Sealed this

Twenty-sixth Day of September, 2000

*Attest:*

Q. TODD DICKINSON

*Attesting Officer*

*Director of Patents and Trademarks*